US010209011B2

(12) United States Patent
Wang et al.

(10) Patent No.: US 10,209,011 B2
(45) Date of Patent: Feb. 19, 2019

(54) HEAT TRANSFER TUBE AND CRACKING FURNACE USING THE SAME

(71) Applicants: CHINA PETROLEUM & CHEMICAL CORPORATION, Beijing (CN); BEIJING RESEARCH INSTITUTE OF CHEMICAL INDUSTRY, CHINA PETROLEUM & CHEMICAL CORP, Beijing (CN)

(72) Inventors: Guoqing Wang, Beijing (CN); Lijun Zhang, Beijing (CN); Xianfeng Zhou, Beijing (CN); Junjie Liu, Beijing (CN); Zhiguo Du, Beijing (CN); Yonggang Zhang, Beijing (CN); Zhaobin Zhang, Beijing (CN); Cong Zhou, Beijing (CN)

(73) Assignees: China Petroleum & Chemical Corporation, Beijing (CN); Beijing Research Institute of Chemical Industry SINOPEC, Beijing (CN)

( * ) Notice: Subject to any disclaimer, the term of this patent is extended or adjusted under 35 U.S.C. 154(b) by 628 days.

(21) Appl. No.: 14/068,543

(22) Filed: Oct. 31, 2013

(65) Prior Publication Data

US 2015/0114609 A1 Apr. 30, 2015

(30) Foreign Application Priority Data

Oct. 25, 2013 (CN) ..... 2013 1 0512687

(51) Int. Cl.
*F28F 1/12* (2006.01)
*F28F 13/12* (2006.01)
(Continued)

(52) U.S. Cl.
CPC ..... *F28F 1/12* (2013.01); *C10G 9/20* (2013.01); *F28F 1/40* (2013.01); *F28F 13/12* (2013.01);
(Continued)

(58) Field of Classification Search
CPC ..... F28F 13/12; F28F 1/40; F28F 19/00
See application file for complete search history.

(56) References Cited

U.S. PATENT DOCUMENTS 1,056,373 A * 3/1913 Segelken ..... F22B 7/20 122/44.2
3,457,982 A * 7/1969 Sephton ..... B01D 1/10 138/38
(Continued)

FOREIGN PATENT DOCUMENTS

CN 2 101 210 U 4/1992
CN 2331945 Y 8/1999
(Continued)

OTHER PUBLICATIONS

English language abstract of CN 2331945Y, Aug. 4, 1999.
(Continued)

*Primary Examiner* — Len Tran
*Assistant Examiner* — Gordon Jones
(74) *Attorney, Agent, or Firm* — Finnegan, Henderson, Farabow, Garrett & Dunner LLP

(57) ABSTRACT

A heat transfer tube includes a twisted baffle arranged in an inner wall of the tube. The twisted baffle extends spirally along an axial direction of the heat transfer tube. The twisted baffle is provided with a non-through gap extending along an axial direction of the heat transfer tube from an end to the other end of the twisted baffle. A cracking furnace uses the
(Continued)

heat transfer tube. The heat transfer tube and cracking furnace have good heat transfer effects and small pressure loss.

11 Claims, 6 Drawing Sheets

(51) Int. Cl.

| | |
|---|---|
| ***C10G 9/20*** | (2006.01) |
| ***F28F 1/40*** | (2006.01) |
| *F28D 21/00* | (2006.01) |
| *F15D 1/02* | (2006.01) |
| *F15D 1/00* | (2006.01) |
| *F28F 1/36* | (2006.01) |

(52) U.S. Cl.
CPC ..... *F15D 1/0005* (2013.01); *F15D 1/02* (2013.01); *F28D 2021/0059* (2013.01); *F28F 1/36* (2013.01); *F28F 2215/00* (2013.01)

(56) References Cited

U.S. PATENT DOCUMENTS

| | | | | |
|---|---|---|---|---|
| 4,874,249 | A | 10/1989 | Kabatek et al. | |
| 5,605,400 | A | 2/1997 | Kojima | |
| 6,615,911 | B1 * | 9/2003 | Bhatti | F28F 7/02 138/38 |
| 2002/0007941 | A1 | 1/2002 | Zhu et al. | |
| 2010/0252247 | A1 * | 10/2010 | Smith, III | F28F 1/325 165/181 |

FOREIGN PATENT DOCUMENTS

| | | | | |
|---|---|---|---|---|
| CN | 102095332 | A | 6/2011 | |
| CN | 202032923 | U | 11/2011 | |
| CN | 103061867 | | 4/2013 | |
| CN | 203240947 | U | 10/2013 | |
| EP | 2 133 644 | A1 | 12/2009 | |
| EP | 2133644 | A1 * | 12/2009 | F28F 1/40 |
| JP | 62-268994 | | 11/1987 | |
| JP | 9-324996 | | 12/1997 | |
| JP | 2005-114220 | | 4/2005 | |
| JP | 2009-186063 | | 8/2009 | |
| KR | 10-1003377 | | 12/2010 | |
| SU | 1758387 | | 8/1992 | |

OTHER PUBLICATIONS

English language abstract of CN 102095332 A, Jun. 15, 2011.
English language abstract of CN 202032923 U, Nov. 9, 2011.
English language abstract of CN 203240947, Oct. 16, 2013.
English language abstract of JP 9-324996, Dec. 16, 1997.
English language abstract of JP 2005-114220, Apr. 28, 2005.
Search Report and Written Opinion from Belgian Patent Office, Application No. BE 201300737, dated May 21, 2015.
Search Report in United Kingdom Application No. GB1319082.2, date of search May 7, 2014.

* cited by examiner

HEAT TRANSFER TUBE AND CRACKING FURNACE USING THE SAME

This application claims benefit of priority under 35 U.S.C. § 119 to Chinese Patent Application No. CN 201310512687.2, filed Oct. 25, 2013, the contents of which are also incorporated herein by references.

TECHNICAL FIELD

The present disclosure relates to a heat transfer tube which is especially suitable for a heating furnace. The present disclosure further relates to a cracking furnace using the heat transfer tube.

TECHNICAL BACKGROUND

Cracking furnaces, the primary equipment in the petrochemical industry, are mainly used for heating hydrocarbon material so as to achieve cracking reaction which requires a large amount of heat. Fourier's theorem says, $$\frac{q}{A} = -k\frac{dt}{dy}$$

wherein q is the heat transferred, A represents the heat transfer area, k stands for the heat transfer coefficient, and dt/dy is the temperature gradient. Taking a cracking furnace used in the petrochemical industry as an example, when the heat transfer area A (which is determined by the capacity of the cracking furnace) and the temperature gradient dt/dy (which is determined by the furnace coil material and burner capacity) are determined, the only way to improve the heat transferred per unit area q/A is to improve the value of the heat transfer coefficient k, which is subject to influences from thermal resistance of the main fluid, thermal resistance of the boundary layer, etc.

In accordance with Prandtl's boundary layer theory, when an actual fluid flows along a solid wall, an extremely thin layer of fluid close to the wall surface would be attached to the wall without slippage. That is to say, the speed of the fluid attached to the wall surface, which forms a boundary layer, is zero. Although this boundary layer is very thin, the heat resistance thereof is unusually large. When heat passes through the boundary layer, it can be rapidly transferred to the main fluid. Therefore, if the boundary layer can be somehow thinned, the heat transferred would be effectively increased.

In the prior art, the furnace pipe of a commonly used cracking furnace in the petrochemical industry is usually structured as follows. On the one hand, a rib is provided on the inner surface of one or more or all of the regions from the inlet end to the outlet end along the axial direction of the furnace coil in the cracking furnace, and extends spirally on the inner surface of the furnace coil along an axial direction thereof. Although the rib can achieve the purpose of agitating the fluid so as to minimize the thickness of the boundary layer, the coke formed on the inner surface thereof would continuously weaken the role of the rib as time lapses, so that the function of reducing the boundary layer thereof will become smaller. On the other hand, a plurality of fins spaced from one another are provided on the inner surface of the furnace pipe. These fins can also reduce the thickness of the boundary layer. However, as the coke on the inner surface of the furnace pipe is increased, these fins will similarly get less effective.

Therefore, it is important in this technical field to enhance heat transfer elements so as to further improve heat transfer effect of the furnace coil.

SUMMARY OF THE INVENTION

To solve the above technical problem in the prior at, the present disclosure provides a heat transfer tube, which possesses good transfer effects. The present disclosure further relates to a cracking furnace using the heat transfer tube.

According to a first aspect of the present disclosure, it discloses a heat transfer tube comprising a twisted baffle arranged on an inner wall of the tube, said twisted baffle extending spirally along an axial direction of the heat transfer tube and being provided with a non-through gap extending from one end to the other end of the twisted baffle along an axial direction of the heat transfer tube.

In the heat transfer tube according to the present disclosure, with the arrangement of the twisted baffle, fluid can flow along the twisted baffle and turns into a rotating flow. A tangential speed of the fluid destroys the boundary layer so as to achieve the purpose of enhancing heat transfer. Besides, the arrangement of the gap reduces the resistance of fluid in the heat transfer tube, which further reduces the pressure loss of the fluid. Moreover, the gap is non-through, i.e., the twisted baffle is still an integral piece with both of the two side edges thereof connecting to the heat transfer tube, thus increasing the stability of the twisted baffle under the impact of the fluid.

In one embodiment, the twisted baffle has a twist angle of between 90° to 1080°. When the twist angle is relatively small, the pressure drop of the fluid and the tangential speed of the rotating fluid are both small. Therefore, the heat transfer tube is of poor effect. As the twist angle turns larger, the tangential speed of the rotating flow would increase, so that the effect of the heat transfer tube would be improved, but the pressure drop of the fluid will be increased. When the twist angle ranges from 120° to 360°, the capacity of the heat transfer tube and the pressure drop of the fluid both fall within proper ranges. The ratio of the axial length of the twisted baffle to the inner diameter of the heat transfer tube is in a range from 1:1 to 10:1. When this ratio is relatively small, the tangential speed of the rotating flow is relatively great, so that the heat transfer tube is of high capacity but the pressure drop of the fluid is relatively great. As the value of the ratio gradually increases, the tangential speed of the rotating flow would turn smaller, and thus the capacity of the heat transfer tube would be decreased, but the pressure drop of the fluid would turn smaller. When this ratio ranges from 2:1 to 4:1, both the capacity of the heat transfer tube and the pressure drop of the fluid would fall within respective proper scopes. The twisted baffle of such size further enables the fluid in the heat transfer tube with a tangential speed sufficient enough to destroy the boundary layer, so that a better heat transfer effect can be achieved and there would be a smaller tendency for coke to be formed on the heat transfer wall.

In one embodiment, the area ratio of the gap to the twisted baffle falls within a range from 0.05:1 to 0.95:1. When this ratio is relatively small, the twisted baffle has a great diversion effect to the fluid, so that the heat transfer effect of the tube is good, but the pressure drop of the fluid is also great. As this ratio turns larger, the diversion effect of the twisted baffle to the fluid and the pressure drop of the fluid would grow smaller, but the heat transfer effect would also accordingly turn poorer. When this ratio stays within the range from 0.6:1 to 0.8:1, both the capacity of the heat transfer tube and the pressure drop of the fluid achieve proper ranges. In addition, with the area ratio within the above range, the fluid has a small pressure loss and the twisted baffle has a high resistance to impact. In one embodiment, the gap has a contour line of a smooth curve, which facilitates flow of the fluids, reduces resistance thereof and further reduces pressure loss of the fluid. In a specific embodiment, the smooth curve comprises two identical curve segments, which are centrosymmetric with respect to a centerline of the heat transfer tube. In one embodiment, the ratio of the width of a starting end of the gap to an inner diameter of the heat transfer tube is in a range from 0.05:1 to 0.95:1, preferably from 0.6:1 to 0.8:1, with either of the curve segments extending from the starting end towards a tail end of the gap. The ratio of the x-axis component of the curvature radius change rate of the curve segment to the inner diameter of the heat transfer tube ranges from 0.05:1 to 0.95:1; the ratio of the y-axis component of the curvature radius change rate of the curve segment to the inner diameter of the heat transfer tube ranges from 0.05:1 to 0.95:1; and the ratio of the z-axis component of the curvature radius change rate of the curve segment to the inner diameter of the heat transfer tube ranges from 1:1 to 10:1. When the ratio of the z-axis component of the curvature radius change rate of the curve segment to the inner diameter of the heat transfer tube is relatively small, the tangential speed of the rotating fluid is great, so that the heat transfer effect is good, but the pressure drop of the fluid is also great. As this ratio turns greater, both the tangential speed of the rotating fluid and the pressure drop of the fluid would grow smaller, but the heat transfer effect would also accordingly turn poorer. When this ratio stays within the range from 2:1 to 4:1, both the capacity of the heat transfer tube and the pressure drop of the fluid achieve proper ranges. The gap contour line formed in this way possesses the best hydrodynamic effects, i.e., a minimum of the hydraulic pressure is generated and a maximum of the impact resistance of the twisted baffle is achieved.

In one embodiment, there are two gaps, which extend from different ends of the twisted baffle towards each other along the axial direction of the heat transfer tube without intersection. The area ratio of the upstream gap to the downstream gap is in a range from 20:1 to 0.05:1. When the ratio is relatively large, both the pressure drop of the fluid and the tangential speed of the rotating fluid are small, so that the heat transfer effect is poor. As this ratio turns smaller, the tangential speed of the rotating fluid would grow larger, and the capacity of the heat transfer tube would be improved, but the pressure drop of the fluid would be increased. When this ratio stays within the range from 2:1 to 0.5:1, both the capacity of the heat transfer tube and the pressure drop of the fluid achieve proper ranges. In addition, the downstream gap is beneficial for further lowering resistance of the fluid so as to lower the pressure drop. Furthermore, the arrangement of an upstream gap and a downstream gap is advantageous for decreasing the weight of the twisted baffle, thus facilitating arrangement and use thereof.

In one embodiment, the twisted baffle is provided with a plurality of holes. Both axial and radial flowing fluids can flow through the holes, i.e., these holes can alter the flow directions of the fluids, so as to enhance turbulence in the heat transfer tube, thus destroying the boundary layer and achieving the purpose of enhancing heat transfer. In addition, fluids from different directions can all conveniently pass through these holes and flow downstream, thereby further reducing resistance to flow of the fluids and reducing pressure loss. Coke pieces carried in the fluids can also pass through these holes to move downstream, which facilitates the discharge of the coke pieces. In a preferred embodiment, the ratio of an axial distance between the centerlines of two adjacent holes to an axial length of the twisted baffle ranges from 0.2:1 to 0.8:1.

According to a second aspect of the present disclosure, it discloses a cracking furnace, comprising at least one, preferably 2 to 10 of heat transfer tubes according to the first aspect of the present disclosure.

In one embodiment, a plurality of the heat transfer tubes are arranged in the radiant coil along an axial direction thereof in a manner of being spaced from each other, with the ratio of a spacing distance to the diameter of the heat transfer tube in a range from 15:1 to 75:1, preferably from 25:1 to 50:1. The plurality of heat transfer tubes spaced from one another continuously alter the fluid in the radiant coil from piston flow into rotating flow, thus improving the heat transfer efficiency.

In the context of the present disclosure, the term "piston flow" ideally means that fluids mix with each other in the flow direction but by no means in the radial direction. Practically however, only approximate piston flow rather than absolute piston flow can be achieved.

Compared with the prior art, the present disclosure excels in the following aspects. To begin with, the arrangement of the twisted baffle in the heat transfer tube turns the fluid flowing along the twisted baffle into a rotating fluid, thus improving the tangential speed of the fluid, destroying the boundary layer and achieving the purpose of enhancing heat transfer. Next, the twisted baffle is provided with a non-through gap extending along the axial direction of heat transfer tube from one end towards the other end of the twisted baffle. The gap decreases resistance of the fluids in the heat transfer tube, thus decreasing pressure loss of the fluid. Besides, the gap is non-through, i.e., the twisted baffle is actually an integral piece with two side edges thereof both connecting to the heat transfer tube, which improves stability of the twisted baffle under the impact of the fluid. In addition, the plurality of holes provided on the twisted baffle can change the flow direction of the fluid so as to strengthen the turbulence in the heat transfer tube and achieve the object of enhancing heat transfer. Moreover, these holes further reduce the resistance in the flow of the fluid, so that pressure loss is further decreased. In addition; coke pieces carried in the fluid can also move downstream through these holes, which promotes the discharge of the coke pieces.

BRIEF DESCRIPTION OF DRAWING

In the following, the present disclosure will be described in detail in view of specific embodiments and with reference to the drawings, wherein, FIG. 1 schematically shows a side view of a heat transfer tube with a twisted baffle according to the present disclosure.

Figure 1:
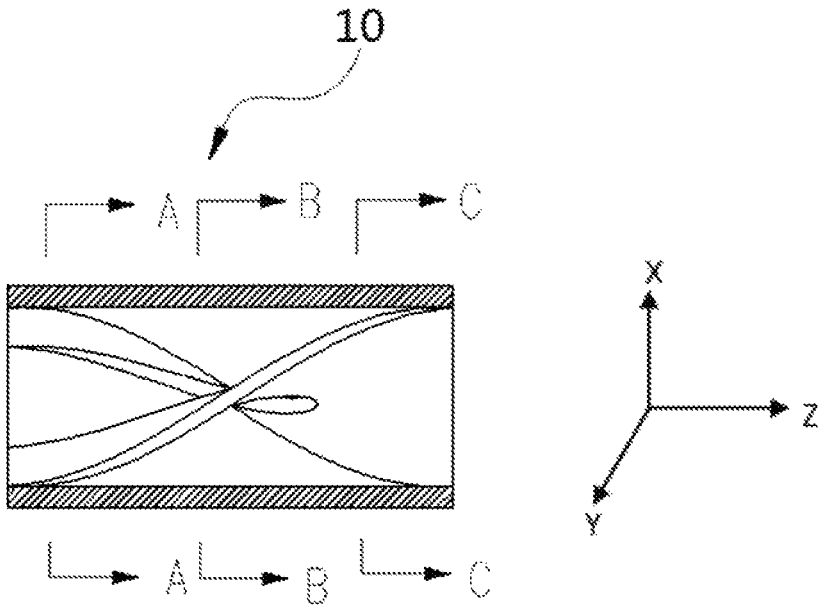

In the drawings, the same component is referred to with the same reference sign. The drawings are not drawn in accordance with an actual scale.

DETAILED DESCRIPTION OF EMBODIMENTS

The present disclosure will be further illustrated in the following in view of the drawings.

FIG. 1 schematically shows a side view of a heat transfer tube 10 according to the present disclosure. The heat transfer tube 10 is provided with a twisted baffle 11 introducing a fluid to flow rotatably. The twisted baffle 11 extends spirally along an axial direction of the heat transfer tube 10. The structure of the twisted baffle 11 is schematically shown in FIGS. 2, 3, 7, 8 and 9 and will be explained in the following.

Figure 2:
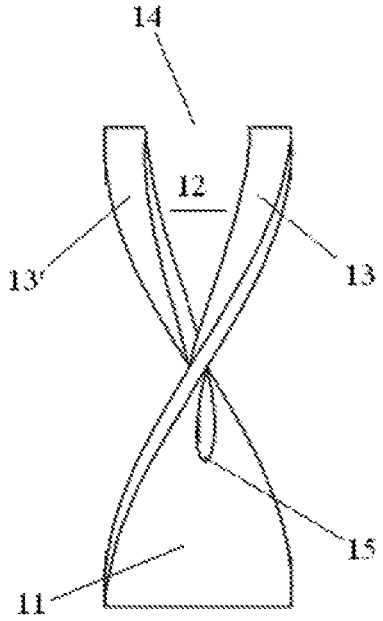
FIGS. 2 and 3 schematically show perspective views of a first embodiment of the twisted baffle according to the present disclosure.
Figure 3:
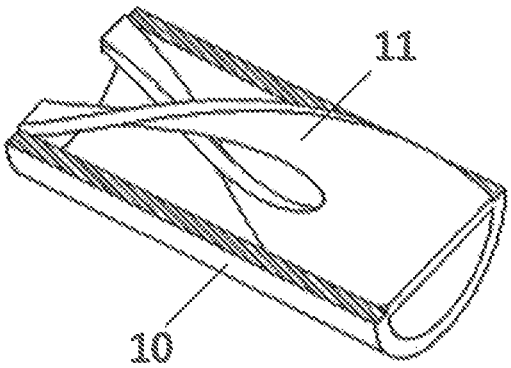

FIGS. 2 and 3 schematically show perspective views of a first embodiment of the twisted baffle 11 according to the present disclosure. The twisted baffle 11 has a twist angle between 90° and 1080°. The ratio of the axial length of the twisted baffle to an inner diameter of the heat transfer tube falls in a range from 1:1 to 10:1. The twisted baffle 11 is arranged with a gap 12, which extends along an axial direction of the heat transfer tube 10 from an upstream end to a downstream end of the twisted baffle 11 without completely penetrating the twisted baffle 11. Generally, the gap 12 can be understood as having a U shape. Under this condition, the area ratio of the gap 12 to the twisted baffle 11 ranges from 0.05:1 to 0.95:1.

The axial length of the twisted baffle 11 can be called as a "pitch", and the ratio of the "pitch" to the inner diameter of the heat transfer tube can be called a "twist ratio". The twist angle and twist ratio would both influence the rotation degree of the fluid in the heat transfer tube 10. When the twist ratio is determined, the larger the twist angle is, the higher the tangential speed of the fluid will be, but the pressure drop of the fluid would also be correspondingly higher. The twisted baffle 11 is selected as with a twist ratio and twist angle which can enable the fluid in the heat transfer tube 10 to possess a sufficiently high tangential speed to destroy the boundary layer, so that a good heat transfer effect can be achieved. In this case, a smaller tendency for coke to be formed on the inner wall of the heat transfer tube can be resulted and the pressure drop of the fluid can be controlled as within an acceptable scope. By arranging the gap 12 on the twisted baffle 11 the contact area of the fluid with the twisted baffle 11 is significantly reduced, thus reducing the resistance of the fluid in the heat transfer tube 10 and the pressure drop of the fluid. In addition, the gap 12 is non-through, i.e., the twisted baffle is actually an integral piece with two side edges thereof both connecting to the heat transfer tube 10, which improves stability of the twisted baffle 11 in the heat transfer tube 10.

FIGS. 2 and 3 show a contour line of the gap 12 of the twisted baffle 11 as a smooth curve, which can reduce the resistance of the fluid, thus reducing the pressure drop of the fluid. The smooth curve can be understood as comprising two identical curve segments 13 and 13', which are centro-symmetric with respect to a centerline of the heat transfer tube 10. With this understanding, the gap 12 possesses the following technical features. The ratio of the width of an starting end of the gap 12 to the inner diameter of the heat transfer tube 10 is in a range from 0.05:1 to 0.95:1 with the curve segment 13 (which is taken as an example for the explanation) extending from a starting end 14 towards a tail end 15 of the gap 12. The ratio of the x-axis component of the curvature radius change rate of the curve segment to the inner diameter of the heat transfer tube ranges from 0.05:1 to 0.95:1; the ratio of the y-axis component of the curvature radius change rate of the curve segment to the inner diameter of the heat transfer tube ranges from 0.05:1 to 0.95:1; and the ratio of the z-axis component of the curvature radius change rate of the curve segment to the inner diameter of the heat transfer tube ranges from 1:1 to 10:1. In the present disclosure, the terms "x-axis", "y-axis" and "z-axis" respectively refer to a diameter direction of the heat transfer tube 10, the direction perpendicular to the drawing sheet and the axial direction of the heat transfer tube 10. The gap 12 in this form possesses the best hydrodynamic effect, i.e., the gap 12 of this form generates the smallest fluid pressure drop and the highest resistance to impact of the twisted baffle 11.

Figure 4:
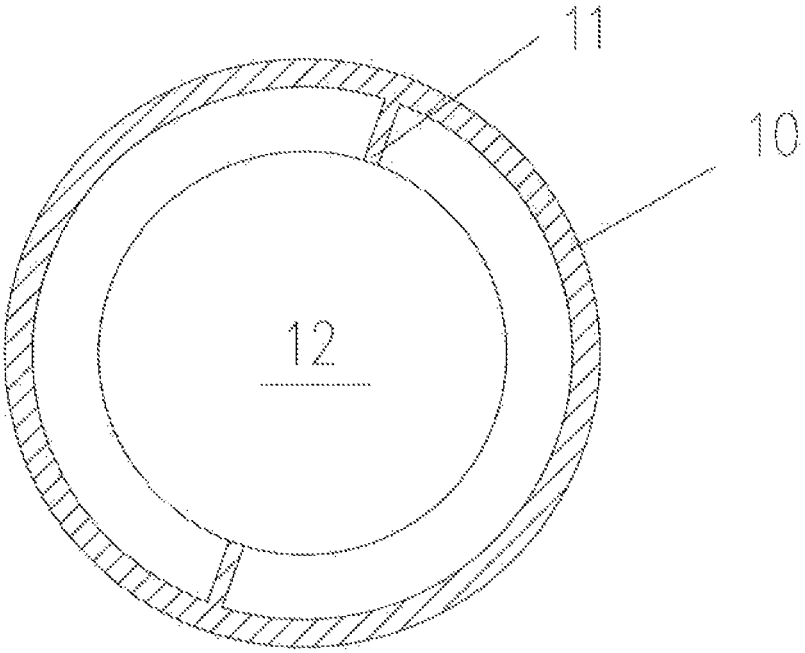
FIGS. 4 to 6 schematically show cross-section views of A-A, B-B and C-C of FIG. 1 using the twisted baffle of FIG. 2.
Figure 5:
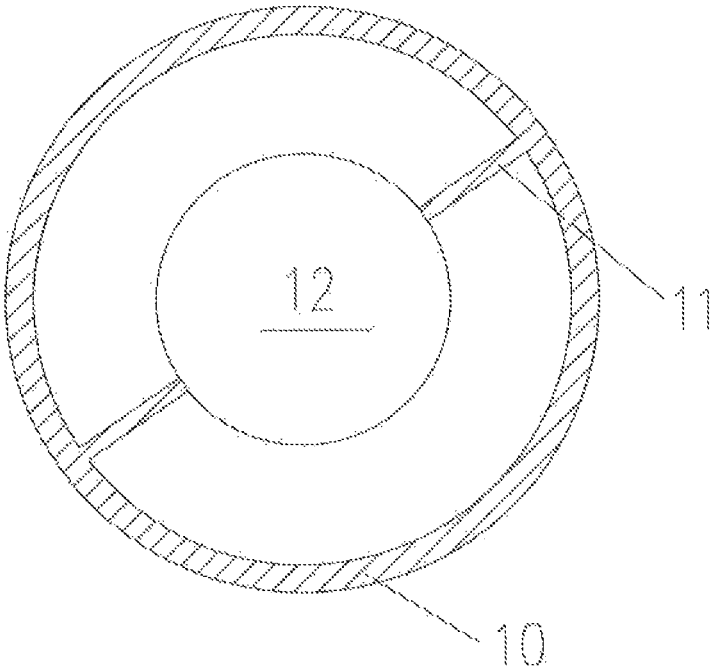
Figure 6:
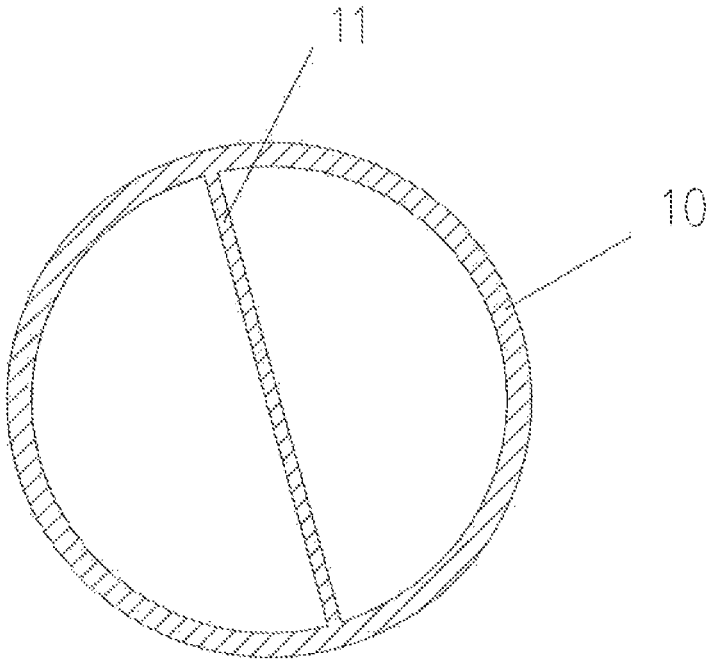

As a matter of fact, the twisted baffle 11 indicated in FIG. 2 or 3 can be understood as a trajectory surface which is achieved through rotating one diameter line of the heat transfer tube 10 around a midpoint thereof and at the same time translating it along the axial direction of the heat transfer tube 10 upwardly or downwardly followed by intersecting a spheroid or the like with the trajectory surface and removing the intersected portion. In this way, the twisted baffle 11 comprises a top edge and a bottom edge parallel to each other, a pair of twisted side edges which always contact with the inner wall of the heat transfer tube 10 and the contour line of the gap. FIGS. 4 to 6 schematically show different cross-sections of the heat transfer tube 10 at different positions. The cross section of the gap 12 as indicated in FIG. 4 is larger than that indicated in FIG. 5, because the cross section A-A is closer to a minor axis of the spheroid which forms the gap 12. The twisted baffle as indicated in FIG. 6 possesses no gaps because the cross section C-C is arranged at a portion of the twisted baffle 11 not being penetrated by the gap 12.

Although FIG. 2 indicates that the gap 12 of the twisted baffle 11 is arranged as with an opening facing upstream and a top end facing downstream, the gap 12 can actually also be arranged as with the top end facing upstream and the opening facing downstream. Under this condition, the impact force from the fluid to the twisted baffle 11 would be significantly reduced, so that the resistance to impact of the twisted baffle 11 would be improved.

Figure 7:
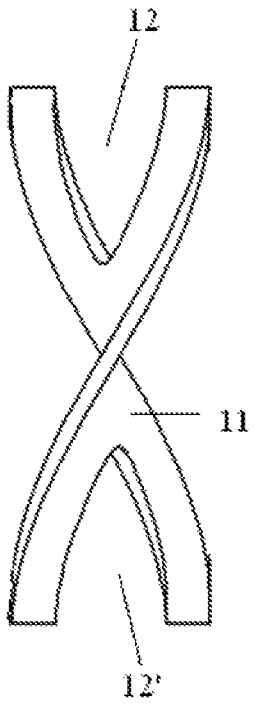
FIGS. 7 and 8 schematically show a perspective view of a second embodiment of the twisted baffle according to the present disclosure.
Figure 8:
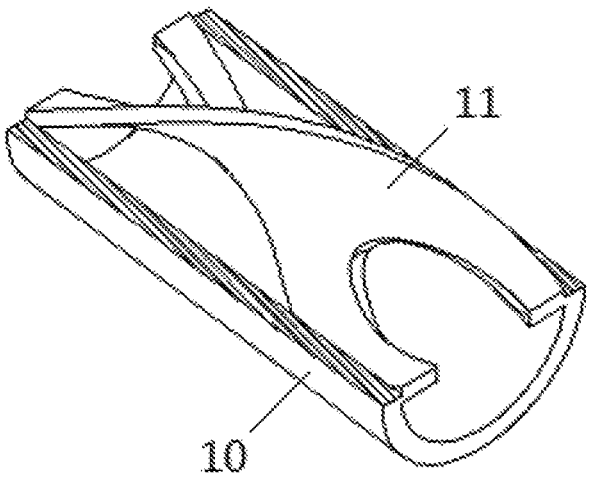

FIGS. 7 and 8 schematically show a second embodiment of the twisted baffle 11. This embodiment is similar with the twisted baffle 11 as indicated in FIGS. 2 and 3. The difference therebetween lies only in that the twisted baffle 11 is provided with two gaps 12 and 12', which extend respectively from an upstream end and a downstream end of the twisted baffle 11 towards each other, but still spaced from each other. The downstream gap 12' can further reduce the resistance of the fluid so as to reduce pressure drop thereof. In addition, the arrangement of the upstream and downstream gaps is beneficial for lowering the weight of the twisted baffle 11, facilitating arrangement and use of the heat transfer tube 10. Preferably, the area ratio of the upstream gap 12 to the downstream gap 12' ranges from 2:1 to 0.5:1. In this case, the ratio of the sum area of the gaps 12 and 12' to the area of the twisted baffle 11 falls within a range from 0.05:1 to 0.95:1.

Figure 9:
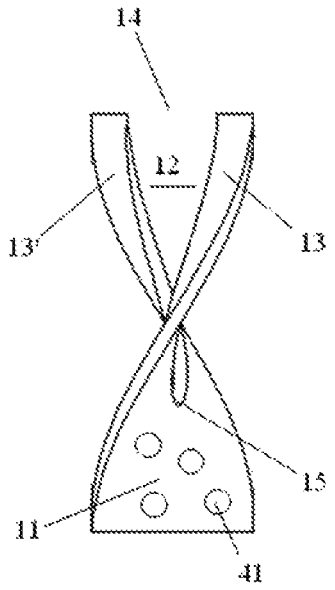
FIG. 9 schematically shows a perspective view of a third embodiment of the twisted baffle according to the present disclosure.

FIG. 9 schematically indicates a third embodiment of the twisted baffle 11. In this embodiment, the twisted baffle 11 is provided with a hole 41, so that the fluid can pass through the hole 41 and smoothly flow downstream, thus further reducing the pressure loss of the fluid. In one specific embodiment, the ratio of an axial distance between two adjacent centerlines to an axial length of the twisted baffle 11 ranges from 0.2:1 to 0.8:1.

Figure 11:
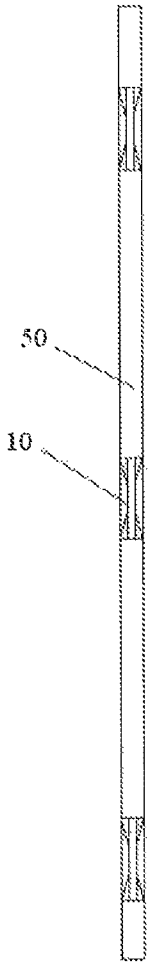
FIG. 11 schematically shows a radiant coil of a cracking furnace using the heat transfer tube according to the present disclosure.

The present disclosure further relates to a cracking furnace (not shown in the drawings) using the heat transfer tube 10 as mentioned above. A cracking furnace is well known to one skilled in the art and therefore will not be discussed here. A radiant coil 50 of the cracking furnace is provided with at least one heat transfer tube 10 as described above. FIG. 11 schematically indicates three heat transfer tubes 10. Preferably, these heat transfer tubes 10 are provided along the axial direction in the radiant coil in a manner of being spaced from each other. For example, the ratio of an axial distance of two adjacent heat transfer tubes 10 to the inner diameter of the heat transfer tube 10 is in a range from 15:1 to 75:1, preferably from 25:1 to 50:1, so that the fluid in the radiant coil would continuously turn from a piston flow to a rotating flow, thus improving the heat transfer efficiency. It should be noted that when there are a plurality of heat transfer tubes, the twisted baffle of each of these heat transfer tubes 10 can be arranged in a manner as shown in any one of FIGS. 2, 7 and 9.

In the following, specific example will be used to explain the heat transfer efficiency and pressure drop of the radiant coil 50 of the cracking furnace when the heat transfer tube 10 according to the present disclosure is used.

EXAMPLE 1

The radiant coil of the cracking furnace is arranged with 6 heat transfer tubes 10 with twisted baffles as indicated in FIG. 2. The inner diameter of each of the heat transfer tubes 10 is 51 mm. The ratio of the x-axis component of the curvature radius change rate of the curve segment to the inner diameter of the heat transfer tube is 0.6:1; the ratio of the y-axis component of the curvature radius change rate of the curve segment to the inner diameter of the heat transfer tube is 0.6:1; and the ratio of the z-axis component of curvature radius change rate of the curve segment to the inner diameter of the heat transfer tube is 2:1. The twisted baffles 11 and 11' respectively have a twist angle of 180° and a twist ratio of 2.5. The distance between two adjacent heat transfer tubes 10 is 50 times as large as the inner diameter of the heat transfer tube. Experiments have found that the heat transfer load of the radiant coil is 1,278.75 KW and the pressure drop is 70,916.4 Pa.

COMPARATIVE EXAMPLE 1

Figure 10:
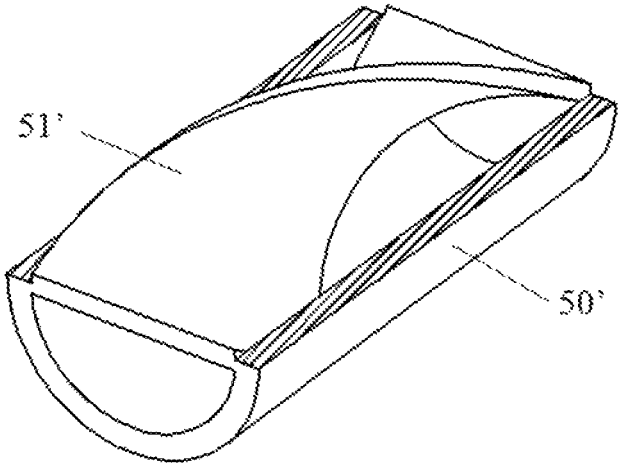
FIG. 10 schematically shows a perspective view of a prior art twisted baffle.

The radiant coil of the cracking furnace is mounted with 6 prior art heat transfer tubes 50'. The heat transfer tube 50' is structured as being provided with a twisted baffle 51' in a casing of the heat transfer tube 50', the twisted baffle 51' dividing the heat transfer tube 50' into two material passages non-communicating with each other as indicated in FIG. 10. The inner diameter of the heat transfer tube 50' is 51 mm. The twisted baffle 51' has a twist angle of 180° and a twist ratio of 2.5. The distance between two adjacent heat transfer tubes 50' is 50 times as large as the inner diameter of the heat transfer tube 50'. Experiments have found that the heat transfer load of the radiant coil is 1,264.08 KW and the pressure drop is 71,140 Pa.

In view of the above example and comparative example, it can be derived that compared with the heat transfer efficiency of the radiant coil in the cracking furnace using the prior art heat transfer tube, the heat transfer efficiency of the radiant coil in the cracking furnace using the heat transfer tube according to the present disclosure is significantly improved, and the pressure drop is also decreased. The above features are very beneficial for hydrocarbon cracking reaction.

Although this disclosure has been discussed with reference to preferable examples, it extends beyond the specifically disclosed examples to other alternative examples and/or use of the disclosure and obvious modifications and equivalents thereof. Particularly, as long as there are no structural conflicts, the technical features disclosed in each and every example of the present disclosure can be combined with one another in any way. The scope of the present disclosure herein disclosed should not be limited by the particular disclosed examples as described above, but encompasses any and all technical solutions following within the scope of the following claims.

What is claimed is:

1. A cracking furnace having a radiant coil, characterized in that the radiant coil comprises 2 to 10 heat transfer tubes, wherein a plurality of the 2 to 10 heat transfer tubes are arranged in the radiant coil along an axial direction thereof in a manner of being spaced from each other, and wherein each of the heat transfer tubes comprises a twisted baffle arranged on an inner wall of said each of the heat transfer tubes, the twisted baffle extending spirally along an axial direction of the heat transfer tube and being provided with a non-through gap extending from one end to the other end of the twisted baffle along an axial direction of the heat transfer tube without penetrating the twisted baffle in the axial direction;

wherein the non-through gap has a contour line of a smooth curve, the smooth curve comprises two identical curve segments, which are centrosymmetric with respect to a centerline of the heat transfer tube;

wherein the contour line is unclosed U-shaped and the non-through gap is not enclosed on all sides by material.

2. The cracking furnace according to claim 1, characterized in that an area ratio of the gap to the twisted baffle falls within a range from 0.05:1 to 0.95:1.

3. The cracking furnace according to claim 1, characterized in that a ratio of a width of a starting end of the gap to an inner diameter of the heat transfer tube is in a range from 0.05:1 to 095:1, with either of the curve segments extending from the starting end towards a tail end of the gap.

4. The cracking furnace according to claim 1, characterized in that the twisted baffle has a twist angle between 90° to 1080°.

5. The cracking furnace according to claim 1, characterized in that a ratio of an axial length of the twisted baffle to an inner diameter of the heat transfer tube is in a range from 1:1 to 10:1.

6. The cracking furnace according to claim 1, characterized in that a ratio of a spacing distance to a diameter of the heat transfer tube is in a range from 15:1 to 75:1.

7. The cracking furnace according to claim 6, characterized in that the ratio of the spacing distance to the diameter of the heat transfer tube is in a range from 25:1 to 50:1.

8. The cracking furnace according to claim 2, characterized in that the area ratio of the gap to the twisted baffle falls within a range from 0.6:1 to 0.8:1.

9. The cracking furnace according to claim 4, characterized in that the twisted baffle has a twist angle between 120° to 360°.

10. The cracking furnace according to claim 5, characterized in that the ratio of the axial length of the twisted baffle to the inner diameter of the heat transfer tube is in a range from 2:1 to 4:1.

11. The cracking furnace according to claim 3, characterized in that the ratio of the width of the starting end of the gap to the inner diameter of the heat transfer tube is in a range from 0.6:1 to 0.8:1.

* * * * *